US007934330B2

(12) United States Patent
Nicolaisen

(10) Patent No.: US 7,934,330 B2
(45) Date of Patent: May 3, 2011

(54) SYSTEM FOR HANGING DIFFERENT ITEMS ON WALLS

(76) Inventor: Pelle Nicolaisen, Hornbaek (DK)

( * ) Notice: Subject to any disclaimer, the term of this patent is extended or adjusted under 35 U.S.C. 154(b) by 387 days.

(21) Appl. No.: 11/574,417

(22) PCT Filed: Aug. 1, 2005

(86) PCT No.: PCT/DK2005/000554

§ 371 (c)(1),
(2), (4) Date: Feb. 28, 2007

(87) PCT Pub. No.: WO2006/024299

PCT Pub. Date: Mar. 9, 2006

(65) Prior Publication Data

US 2009/0140120 A1 Jun. 4, 2009

(30) Foreign Application Priority Data

Sep. 2, 2004 (DK) ..... 2004 01329

(51) Int. Cl.
*A47G 1/17* (2006.01)

(52) U.S. Cl. ..... 40/711; 248/205.3

(58) Field of Classification Search ..... 40/711, 40/757–764; 248/205.3, 206.5, 467
See application file for complete search history.

(56) References Cited

U.S. PATENT DOCUMENTS

| | | | | | |
|---|---|---|---|---|---|
| 1,735,883 | A | * | 11/1929 | Smith | 40/618 |
| 3,023,991 | A | * | 3/1962 | Fisher | 248/205.3 |
| 3,336,682 | A | * | 8/1967 | Genin | 434/416 |
| 3,604,673 | A | * | 9/1971 | Klein | 248/467 |
| 3,786,584 | A | * | 1/1974 | Holson | 40/124 |
| 4,040,194 | A | | 8/1977 | Penton et al. | |
| 4,875,654 | A | * | 10/1989 | Chandonnet et al. | 248/467 |
| 5,269,083 | A | * | 12/1993 | Vampatella et al. | 40/711 |
| 6,651,945 | B2 | | 11/2003 | Rivellino et al. | |
| 6,672,551 | B2 | * | 1/2004 | Rivellino et al. | 248/206.5 |
| 7,114,278 | B2 | * | 10/2006 | Marks et al. | 40/722 |

FOREIGN PATENT DOCUMENTS

| | | | |
|---|---|---|---|
| DE | 7631504 | U | 1/1977 |
| DE | 3236760 | A1 | 4/1984 |
| FR | 2645421 | A1 | 10/1990 |
| GB | 2191089 | A | 12/1987 |
| WO | 9602171 | A1 | 2/1996 |

* cited by examiner

*Primary Examiner* — Joanne Silbermann
*Assistant Examiner* — Shin Kim
(74) *Attorney, Agent, or Firm* — Brooks Kushman P.C.

(57) ABSTRACT

The invention relates to a system for hanging items, such a pictures, posters, paintings or the like on walls and other surfaces. The picture (1) shows one or more magnets contacting a fitting which is fastened to the wall by magnetic attractive material to a certain extent in the same plane as the wall. The system makes it possible to adjust the position of the picture both horizontally (16) and vertically (17). The magnet is fastened to the picture in a way which makes it possible for the picture to tilt both around a horizontal and a vertical axis in the same level as the wall and which makes it possible for the picture to equalize potentially differences in the parallelism between the wall fitting and the picture. When hanging the picture the magnet risks furthermore moving away form the picture, which results in the magnet itself, will find its way towards the fitting. The wall fitting has either spikes (13) or friction searching material, which will be pressed into the wall when the fitting is getting fastened with a single screw (14) and thereby prevent the fitting from rotating while the position of the picture is being adjusted. The fitting is constructed with some enhancements. These prevent the magnet from sliding off the fitting, when the position of the picture is being adjusted. The enhancements are constructed with holes which make it possible to release the magnet from the wall fitting in a movement parallel to the level of the wall.

17 Claims, 5 Drawing Sheets

SYSTEM FOR HANGING DIFFERENT ITEMS ON WALLS

THE INVENTIONS SCOPE OF APPLICATION

Figure 1:
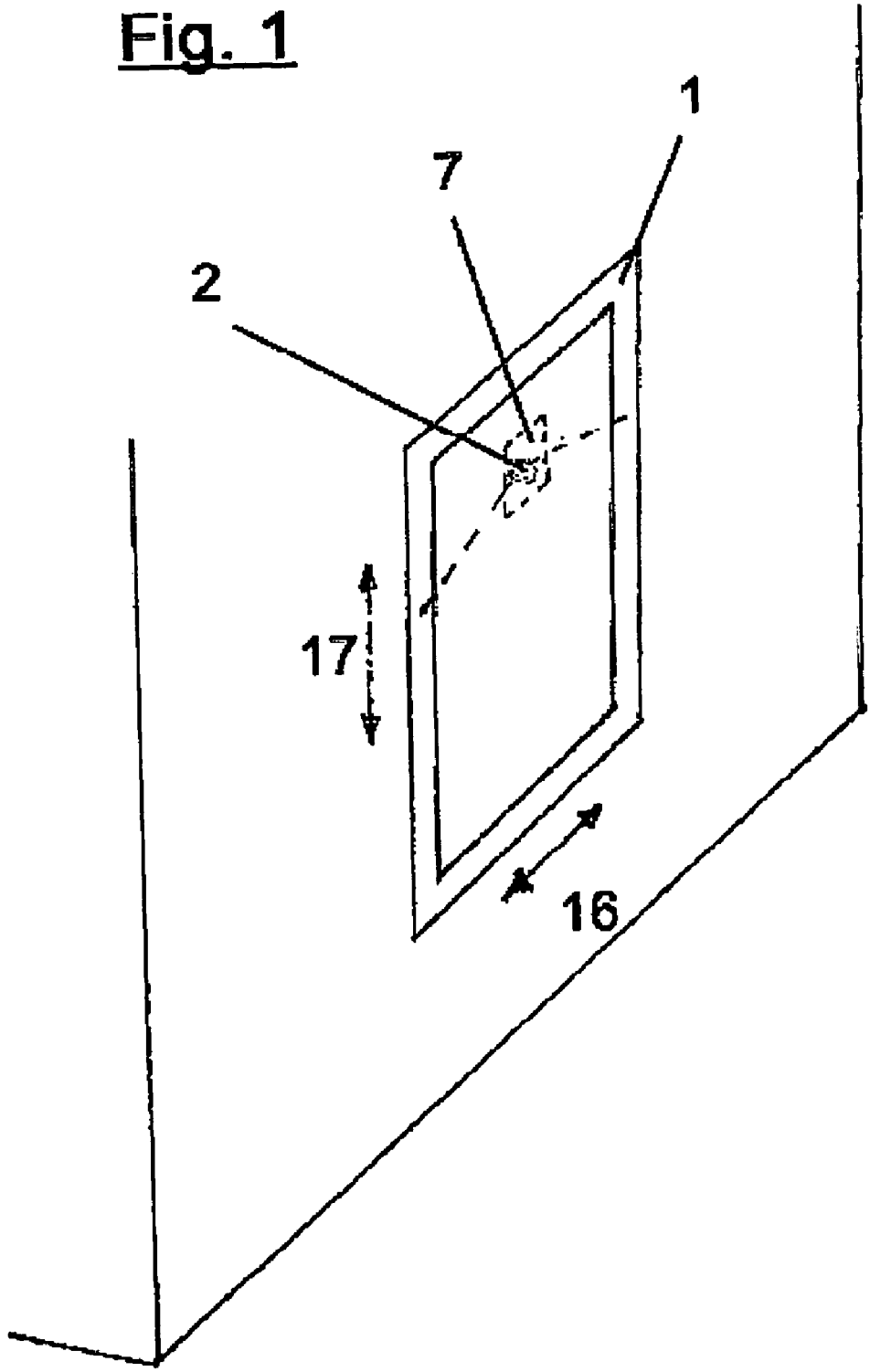

The invention relates to a system for hanging items, such as pictures, posters, paintings or the like (in the following just mentioned as pictures) on surfaces which mainly are plane (in the following mentioned as walls)

STATE OF THE ART

Typically pictures and other items are using a screw or a nail which is secured on the wall so that the head is sticking out of the wall. On the back of the picture there is mounted either a relative horizontal cord/wire or a fitting into which there is a hole. Afterwards the cord/wire or the fitting is hung from the screw head which is sticking out of the wall. It is often difficult to make the cord/wire or the fitting to get hold onto the screw head as normally has to be done while not being able to see what is happening behind the picture. Furthermore there is often a risk that the cord/wire will bend away from the wall and thereby make it difficult get hold onto the screw head. When the picture finally is hanging on the wall one will often discover that the picture is not hanging in the wanted position. Hereafter one needs to tighten or loosen the cord/wire either to raise or lower the position. If one wishes to move the picture sideways one needs to fasten the screw in a new position.

U.S. Pat. No. 6,651,945 and U.S. Pat. No. 6,672,551 describe a principle according to that which a hook with a magnet is mounted on the wall. The magnet makes it easier for the hook to get on to the wire on the back of the picture—provided that the wire is made of material which has an attractive force for magnetism.

GB 2 191 089 describes a construction where a hook is combined with a magnetic plate. The hook can be placed arbitrary on a wall provided that the wall consists of a material which has an attractive force for magnetism.

This construction is furthermore characterized by the fact that the magnetic plate is an alloy of a magnetic material and of rubber. Thereby the coefficient of the friction between the plate and wall will increase and so will the strength with which the picture is fastened to the wall.

U.S. Pat. No. 5,269,083 describes a principle for fastening according to a magnet on the back of the picture is used for fastening it in a larger frame, in which more than one picture can be placed. This patent describes how one can release the picture by tilting it with a pressure in the periphery of the picture, as the magnet has a certain thickness and therefore creates an edge from which you can tilt the picture. This very tilt causes the magnet to let go of the metal which the magnet has been fastened to.

What You Achieve by the New Invention:

1. a possibility of securing that the picture will not slip out of contact with the metal as the wall fitting is enclosed by enhancements.
2. a possibility of releasing the picture from the metal by sliding the picture parallel with the wall and out through the said enhancements.
3. the preliminary undertakings for hanging the picture is easier as one does not need to be very precise when creating engagement between that part of the hanging system which is positioned on the wall and the part which is placed on the picture. Furthermore the picture itself helps getting engaged.

4. a subsequent adjusting of the position of the picture is easier, as the picture can be slid vertically as well as horizontally in the plane of the wall inside a certain area limited by the dimensions of the hanging system.

Means to be Applied

You achieve the above mentioned possibilities for a system for hanging items (1) including pictures, posters, paintings etc. (in the following mentioned as pictures) mainly on plane surfaces (in the following mentioned as walls) comprising one on the wall attached wall fitting (7) of a magnetic attracting material, to a certain extent on the wall level and with one or more enhancements, and one or more magnets attached to the picture characterized by the dimensions of the magnet (2) allows a certain movement of the said during constant contact with the wall fitting as the extent of the magnet is smaller than the area which is limited by the enhancements (18) on the wall fitting (7)

The "Hanging" Systems Mode of Operation

Whenever the magnets get in contact with the wall fitting they will be able to secure the picture in the wanted position on the wall. It will be advantageously to use magnets of the type NeoDymium; they belong to the strongest group of magnets on the market.

In order to equalize the differences in the parallelism between the plane of the picture, the wall, the fitting and the magnet, which will guarantee a good hanging, the magnet is fastened to the picture and is tilt able both around a horizontal and a vertical axis by means of a cord/wire or a string or alternatively to a pin on the magnet, which is mounted through a hole in a fitting secured to the picture.

The hole has the same geometry as the profile of the pin, but is slightly oversized. At the end of the pin there is a jut of a bigger dimension than the hole. This will prevent the pin and thereby the magnet too from falling out.

This fastening principle between the magnet and the picture makes it possible to move the magnet perpendicularly to the back of the picture. This is useful when the magnet during the progress of the hanging shortly before it is positioned on a level with the fitting on the wall, as the magnet itself thus will find its way towards the fitting.

In order to make an easy mounting possible it is desirable that the fitting can be fastened with a single screw on the wall.

In order to avoid the rotation of the fitting around this screw, when adjusting the position of the picture on the wall, the fitting is constructed with some bended spikes which will be pressed into the wall when the fitting is getting fastened into the said. Alternatively, there is one or more areas covered with friction increasing material (e.g. rubber soles) on the back of the fitting.

In order so that the magnet does not slide off the fitting on the wall unintendedly, for example while the position of the picture is adjusted or if the picture later on gets an unintended push, the fitting is constructed with some enhancements/bends along its periphery. These prevent the magnet from sliding off the fitting and out on the wall. As it can also be a good idea purposely to release the magnet/picture from the wall by sliding the magnet off the edge there is one or more openings in these enhancements, which are bigger than the magnet. As such, the area of the fitting may also be bigger than the area of the magnet. It is hereby avoidable to pull the picture down perpendicularly to the wall, which can cause relatively great forces in the system.

In order to exploit the energy from the magnet as much as possible either the fitting or the surface of the magnet, is provided with a friction increasing material by means of which the ability of carrying the "hanging" system is increased.

LIST OF FIGURES

Figure 2:
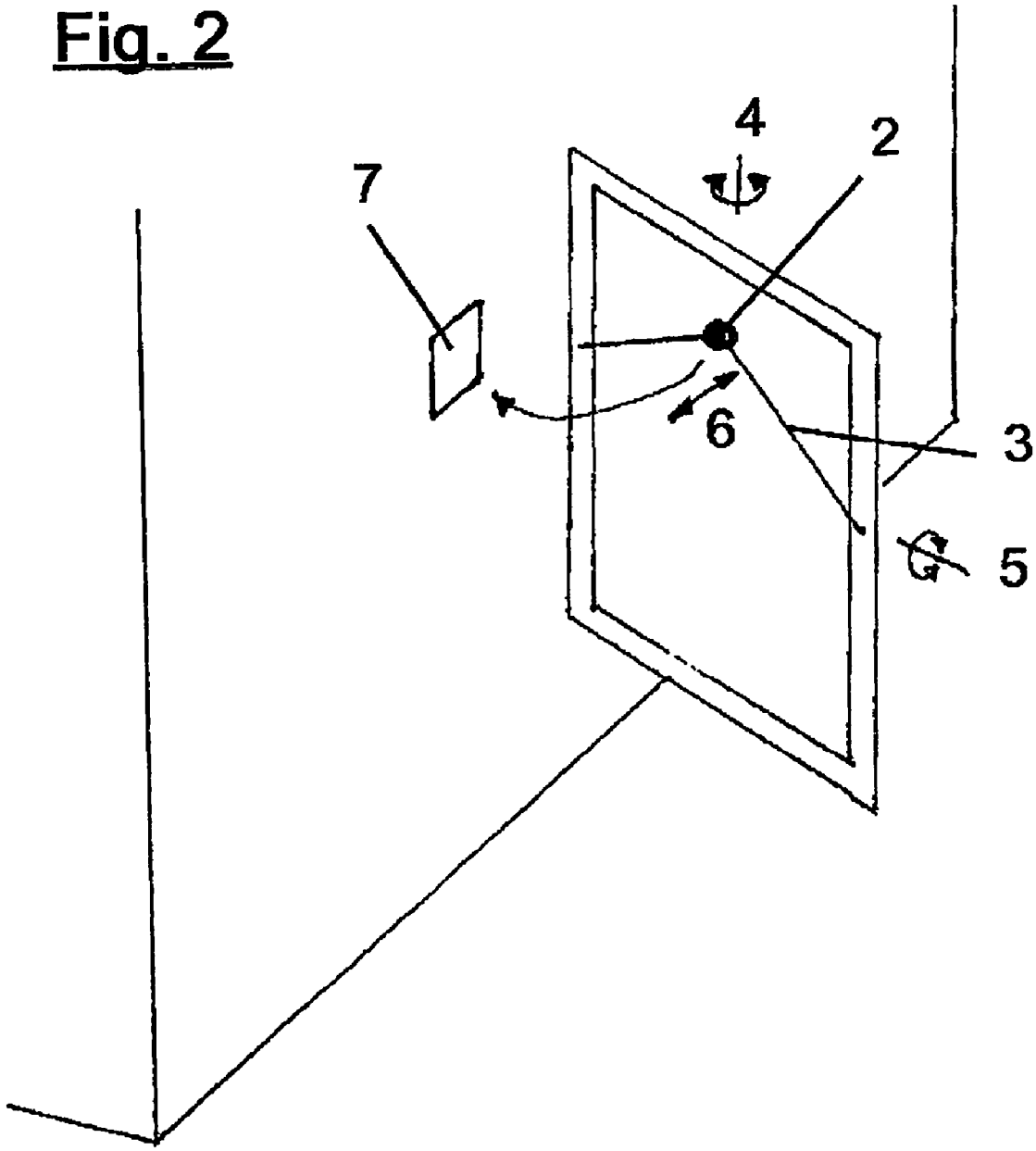

FIG. 1—The picture is hanging on the wall, specification of ways of adjustments FIG. 2—shows the fitting on the wall and the magnet mounted with a cord/wire on the back of the picture. Still the magnet is not in contact with the fitting.

Figure 3:
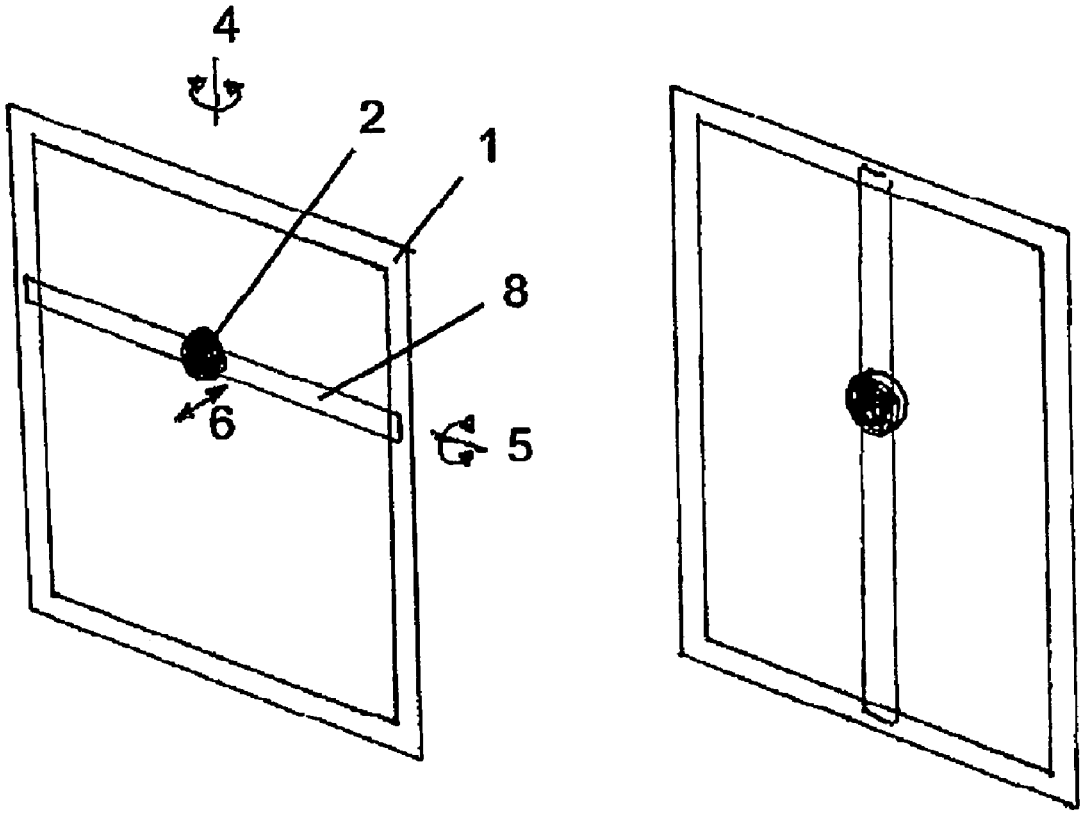

FIG. 3—the magnet mounted on a cord (vertically and horizontally)

Figure 4:
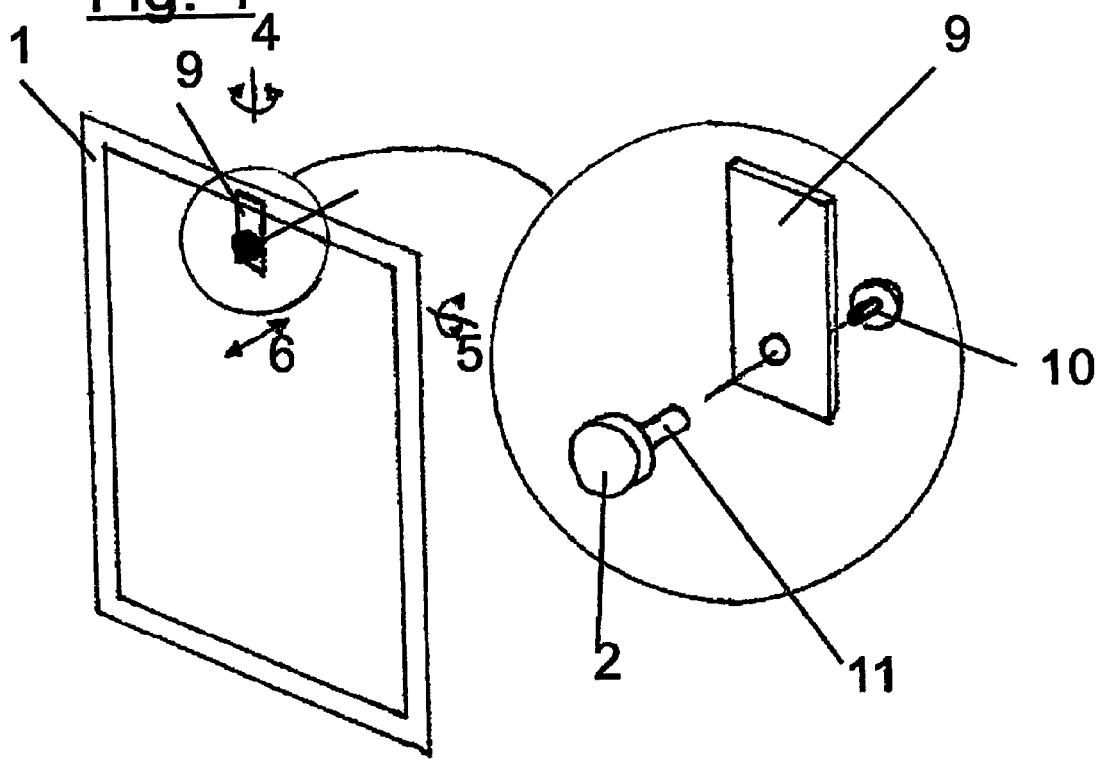
Figure 5:
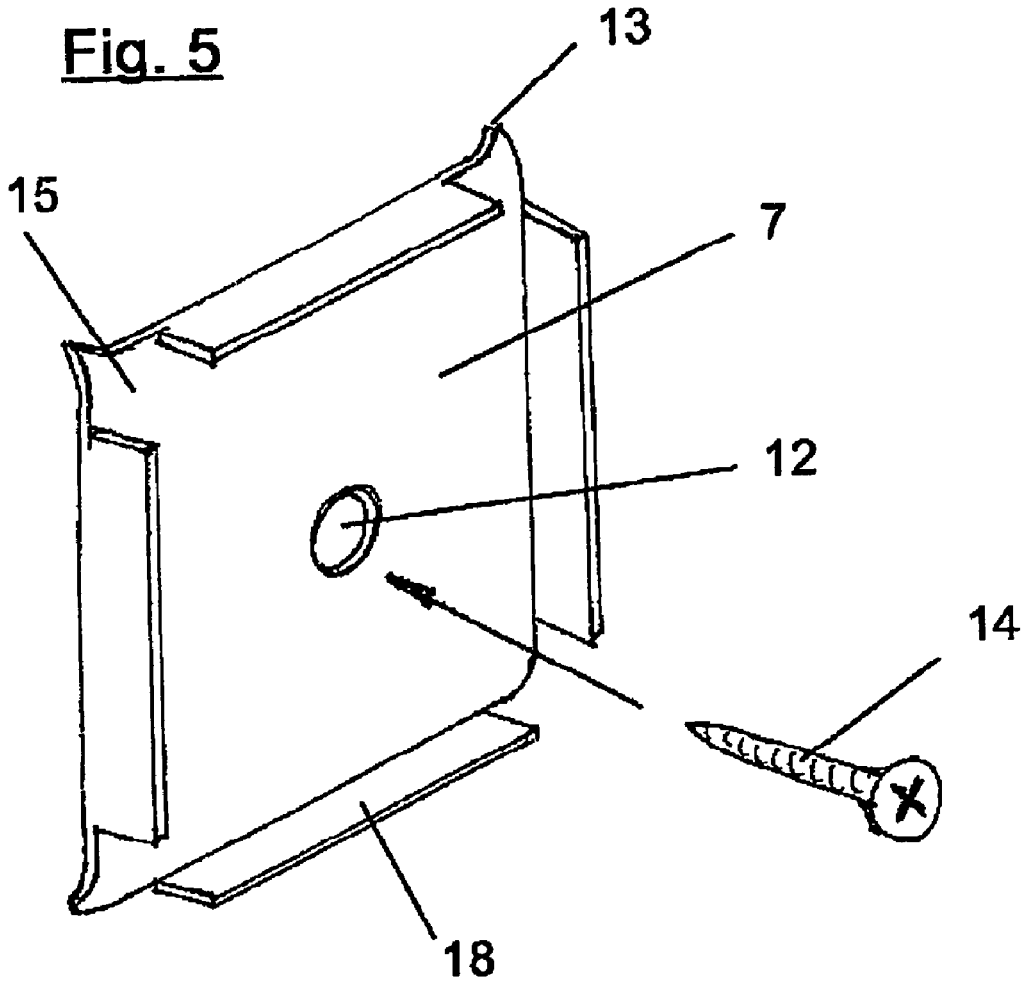

FIG. 4—the magnet mounted in a hole in the fitting fastened to the back of the picture FIG. 5—design of the fitting prepared for mounting on the wall FIG. 1 shows the picture hanging on the wall fastened with a cord/wire and a fitting (7) mounted on the wall. It is possible to move the picture without gradation horizontally (16) and vertically (17) on a level with the wall.

FIGS. 2, 3, and 4 show different ways of mounting the magnet (2). FIG. 2 shows a mounting on a wire/cord (3), FIG. 3 shows a mounting on a string (8) and FIG. 4 shows a mounting through a hole in the fitting (9). It is also specified in the figures that the picture can tilt around both a vertical (4) and a horizontal (5) axis on a level with the wall, and can be moved against or away (6) from the wall.

FIG. 4 shows furthermore how a pin (11) on the magnet is mounted through an oversized hole in the fitting (9). Hereby the opportunity of tilting the picture both horizontally (4) and vertically (5) in relation to the magnet is achieved.

A screw (10) whose head has a diameter which is bigger than the hole in the magnet is fastened inside the magnet (2), so the magnet cannot fall out.

The pin (11) is longer than the fitting (9) is thick/deep, which means that the magnet can move at right angels to the fitting.

FIG. 5 shows the fitting (7) ready for mounting on the wall. The fitting has a single hole (12) through which it will be fastened to the wall with a single screw (14). The fitting is furthermore shown with spikes (13) which, when the screw (14) is fastened, simultaneously, will be pressed into the wall and thereby prevent the fitting from rotating while the position of the picture is being adjusted.

In stead of spikes areas with a friction increasing surface, for example rubber soles, (not shown on the figure) can be added to the back of the fitting.

FIG. 5 shows furthermore that the fitting (7) has some small rims (18) along the periphery of the said.

The purpose of these rims is to avoid that the magnet unintendedly slides out of contact with the fitting (7). In the periphery there are, however some areas with an opening (15) in the rims. The purpose of these openings is to make it possible for the magnet to slide out of contact with the fitting when intended to do so. This will reduce the forces in the system when removing the picture in a movement at right angels to the fitting.

NUMBERING

1. picture
2. magnet
3. cord
4. horizontally related to the magnet
5. vertically related to the magnet
6. movement against or away from the wall
7. fitting
8. mounting on a string
9. oversized hole in the fitting
10. screw
11. pin
12. hole in the fitting
13. spikes in the fitting
14. screw for the fitting
15. openings in the rims of the fitting
16. possibility for horizontal movements
17. possibility for vertical movements
18. rims of the fitting

The invention claimed is:

1. A system for hanging pictures on mainly plane surfaces and walls, the system for hanging pictures comprising:

a pair of hanging members such that one of the hanging pair members is adapted for mounting on the wall, and the other hanging member is adapted to mounting on a picture, the pair of hanging members including:

a first hanging member including one or more magnets, and a second hanging member is a plate formed of magnetic attracting material with at least one flange formed along the periphery of the plate and at least one opening formed in the flange along the periphery, the surface area of the plate of the plate being larger than the area of the magnet so that the picture is adjustable by sliding and rotating the magnet along the plate in a horizontal and vertical direction parallel to the wall, the movement of the magnet thereby limited when the magnet contacts the flange, the magnet released from engagement with the plate when the magnet slides through the opening with a movement parallel to the level of the wall, so that the picture may be removed from the wall without having to overcome the magnetic connection force between the plate and the magnet.

2. System for hanging pictures according to claim 1 wherein the magnet is allowed to tilt in relation to the picture, both around a horizontal and a vertical axis in the level of the picture while the magnet and the plate remain in magnetic contact and continue to attach the picture to the wall.

3. System for hanging pictures according to claim 2 wherein the magnet is allowed to tilt in relation to the picture, by attaching to a pin to a fitting on the picture through an aperture defined in the picture fitting.

4. System for hanging pictures according to claim 1 wherein the magnet is adjustable backwards and forwards in a direction perpendicular to the level of the picture, in order to adjust the position of the picture while the magnet and the plate remain in magnetic contact and continue to attach the picture to the wall.

5. System for hanging pictures according to claim 4 wherein the magnet is adjustable backwards and forwards in a direction perpendicular to the level of the picture, wherein the magnet further includes a pin, which is attached to a fitting on the picture through an aperture defined in the picture fitting, wherein the pin is longer than the thickness of the picture fitting.

6. System for hanging pictures according to claim 4 wherein the magnet is adjustable backwards and forwards in a direction perpendicular to the level of the picture, by fastening the magnet to the picture using a cord/wire or a string.

7. System for hanging pictures according to claim 1 wherein the at least one hanging member is attached on the wall with a single fastener.

8. System for hanging pictures according to claim 1 wherein a friction increasing surface is disposed between the plate and the magnet-in order to increase the holding force between the magnet and the plate.

9. System for hanging pictures according to claim 1 wherein the plate counteracts rotation of the fitting when mounted on the wall.

10. System for hanging pictures according to claim 1 wherein the at least one hanging member counteracts rotation when mounted on the wall.

11. System for hanging pictures according to claim 10 wherein the fitting the hanging member further includes one or more spikes which can be pressed into the wall in order to counteract rotation of the hanging member when mounted on the wall.

12. System for hanging pictures according to claim 1 wherein the at least one hanging member includes a friction increasing surface in order to increase the holding force between the magnet and the plate.

13. System for hanging pictures according to claim 1 wherein a friction increasing surface is disposed between at least one hanging member and the wall in order to resist rotation.

14. System for hanging pictures according to claim 1 wherein the magnet is allowed to rotate in relation to the plate, in order to adjust the level of the picture while the magnet and the fitting remain in magnetic contact and continue to attach the picture to the wall.

15. System for hanging pictures according to claim 1 wherein there are a plurality of flanges disposed along the periphery of the plate, the plurality of flanges define a plurality of release openings between the plurality flanges along the periphery of the plate.

16. A System for hanging pictures on plane surfaces and walls, the picture hanging system comprising:

a pair of hanging members including:

a first hanging member formed of magnetic attracting material, the first hanging member having a substantially planar portion with at least one flange disposed along the periphery of the planar portion, the flange defining a release opening along the periphery of the planar portion; and a second hanging member including one or more magnets, wherein one of the hanging pair members is adapted for mounting on the wall, and the other hanging member is adapted to be mounted on a picture such that when the picture is hung on the wall and the hanging pair members are magnetically connected, the position of the picture is adjustable by sliding the magnet in a vertical and horizontal direction along the planar portion, while the magnet remains in magnetic contact with planar portion, the magnet being releasable from the planar portion by sliding the magnet through the release opening so that the magnet is no longer in contact with the planar surface.

17. A system for hanging pictures on plane surfaces and walls, the picture hanging system comprising:

a first hanging member formed of magnetic attracting material, the first hanging member having a substantially planar connecting portion defined by a plurality of at flanges disposed along the periphery of the connecting portion, a plurality of release openings defined along the periphery of the planar portion between the plurality of flanges; and a second hanging member including at least one magnet, the magnet adapted to slide and rotate along the connecting portion of the plate the movement of the magnet thereby limited when the magnet contacts the plurality of flanges, the magnet released from engagement with the connecting portion when the magnet slides through one of the plurality of release openings, wherein one of the hanging pair members is adapted for mounting on the wall, and the other hanging member is adapted to be mounted on a picture such that the hanging pair members are magnetically connected when the picture is hung on the wall and the position of the picture is adjustable by sliding the magnet in relation to the connecting portion.

* * * * *

UNITED STATES PATENT AND TRADEMARK OFFICE

CERTIFICATE OF CORRECTION

PATENT NO. : 7,934,330 B2
APPLICATION NO. : 11/574417
DATED : May 3, 2011
INVENTOR(S) : Pelle Nicolaisen It is certified that error appears in the above-identified patent and that said Letters Patent is hereby corrected as shown below:

Column 4, Line 23, Claim 1:

After "of the plate"
Delete "of the plate" (second occurrence).

Column 6, Line 19, Claim 17:

After "plurality of"
Delete "at".

Signed and Sealed this
Sixth Day of September, 2011

David J. Kappos

David J. Kappos
*Director of the United States Patent and Trademark Office*